US005701675A

United States Patent [19]

Hall et al.

[11] Patent Number: 5,701,675

[45] Date of Patent: Dec. 30, 1997

[54] AXE COMBINATION TOOL

[75] Inventors: David K. Hall, Kodak; Kit Rae, Sevierville, both of Tenn.

[73] Assignee: United Cutlery Corporation, Sevierville, Tenn.

[21] Appl. No.: 644,132

[22] Filed: May 10, 1996

[51] Int. Cl.[6] ..... B26B 23/00

[52] U.S. Cl. ..... 30/123; 30/125; 30/308.1

[58] Field of Search ..... 30/122, 123, 125, 30/308.1; 7/159

[56] References Cited

U.S. PATENT DOCUMENTS 2,005,176 6/1935 Arbuckle ..... 30/125 X 3,219,316 11/1965 Fried ..... 30/308.1 X 3,252,489 5/1966 Huston et al. ..... 30/125 X

FOREIGN PATENT DOCUMENTS 1057029 5/1959 Germany ..... 30/125

*Primary Examiner*—Douglas D. Watts

*Attorney, Agent, or Firm*—Lalos & Keegan

[57] ABSTRACT

An axe is provided with an open cavity in the handle for receiving a removably secured secondary tool. A securing assembly includes a spring biased projecting member extending from the secondary tool passing through a hole in the axe handle. The securing assembly maintains the tool in the axe handle while permitting its easy release. The axe handle is made of a lightweight, high strength material such as fiberglass reinforced nylon.

8 Claims, 1 Drawing Sheet

AXE COMBINATION TOOL

FIELD OF THE INVENTION

This invention relates to camping, hunting or fishing tools and more particularly to an axe capable of carrying a removably secured knife within in its handle. This invention further relates to the novel construction of such knife-axe combination tool.

BACKGROUND OF THE INVENTION

Often when camping, hunting or fishing the sportsman carries with him an axe, knife and other equipment necessary for cutting, trimming, cooking and other functions while in the field. It is common for the sportsman to carry such equipment among other things, on his side in a belt or a sheath or in a backpack. While carrying such items, it can become cumbersome and heavy when hiking or climbing. It also may become necessary at times for the sportsman to gain easy access to his knife, axe or other tools when needed. Thus, a combination tool that is lightweight, small and easily accessible would be of great advantage to the sportsman in the camping or sport environment.

Multifunction or combination tools are well known in the art. One of the most famous multifunction or combination tools is the Swiss Army Knife, which has a variety of instruments, each with a different purpose and all pivotally attached within and to a case or housing that serves as a handle. The design of such tools, however, always involves a compromise in the selection of instruments, their size and range of motion and how they are to be deployed. Many combination tools having a great many instruments are simply poor substitutes for full size individual tools. In almost all cases the combination tools are attached to one unit at a pivot point and cannot be completely removed for use individually, and thus a significant limitation in the usefulness of such a tool exists. This is especially true in the camping, hiking or sport environment where space and weight are of the essence, yet usefulness of the tool cannot be compromised.

Therefore there is a need, in the camping or sport environment, for a lightweight, space saving combination tool that provides for the complete removability of a full size secondary tool that can be used without the limitation of being connected to a housing or other secondary tools.

SUMMARY OF THE INVENTION

This present invention provides the convenience of having an axe and a secondary tool consolidated in a single item for carrying purposes thereby fulfulling the need of the camper, hiker or sportsman to have less items to carry, less weight and more convenience of access when in the wilderness or field.

The invention further provides a secondary tool that is full size, completely removable and independent of any permanent connections to other tools or housing, thereby allowing for utility of the secondary tool without limitation. In addition, the secondary tool can be one of an assortment of secondary tools, each possessing different characteristics and functions from which the user can select depending on his particular needs. For instance, when camping he may choose a knife as the secondary tool, but while out chopping wood in his back yard, he may select a blade file or other implement as the secondary tool. The options are numerous and any secondary tool meeting any specific need can be designed to fit within an axe handle cavity, thus providing the user with the flexibility and freedom of choice depending on his particular need.

This invention further provides a novel construction of an axe with a head on a first end and a handle on its second end that possesses an open cavity for receiving a removable secondary tool, where such secondary tool can be a knife or some other full size implement.

This invention further provides a novel securing means that operatively secures the secondary tool within the axe handle cavity, where such securing means comprises a spring biased projecting member that extends from the secondary tool through a hole in the handle of the axe while the secondary tool is received within the cavity. The projecting member is housed within a chamber in the secondary tool. The diameter of the chamber in the secondary tool is large enough to receive the projecting member and the biasing spring. The chamber has an opening with a diameter smaller than the chamber diameter, and the projecting member includes a first end that can pass through the smaller opening diameter, and a flange on the second end of the projecting member, where the flange diameter is greater than the opening reduced diameter, whereby the projecting member is prevented from passing completely out of the chamber.

The secondary tool has a gripping portion that includes a depressed portion for grasping the secondary tool when the secondary tool is received within the cavity. The axe handle includes a cutout portion substantially aligned with the depressed portion of the secondary tool for accessing the secondary tool when the secondary tool is received in the cavity.

The novel securing means described thus provides the advantageous feature of easy release of the secondary tool from the cavity of the axe handle for convenient access, while also providing secure containment while the secondary tool is in the stored position.

The invention further provides a head of the axe with a first end displaced from the handle along the head's longitudinal axis wherein the first end of the head includes a sharpened edge that is substantially parallel to the handle. The head also includes a second end that is remote from the first end along the longitudinal axis wherein the second end includes a blunt edge. The head can be made of a high carbon steel or any other acceptable material providing strength, durability and sufficient cutting capability.

Thus the user of the axe has the benefit of carrying a single axe with a secondary tool received inside the axe handle, with a quick release mechanism for easy removal of the secondary tool with convenient access for use.

The axe handle is made of high strength, lightweight materials such as fiberglass reinforced nylon to satisfy weight and performance design considerations, but could be made from any material satisfying structural and performance requirements. The knife handle has a rubber coated gripping surface with a checkered texture to provide the user with improved gripping.

Other features and advantages of the present invention will be apparent to one skilled in the art of combination or multifunction tools.

The present invention can be fully appreciated by reference to the following detailed description of the preferred embodiment, which is also illustrated in the accompanying drawings that are described below.

DETAILED DESCRIPTION

Figures 1, 2, 3:
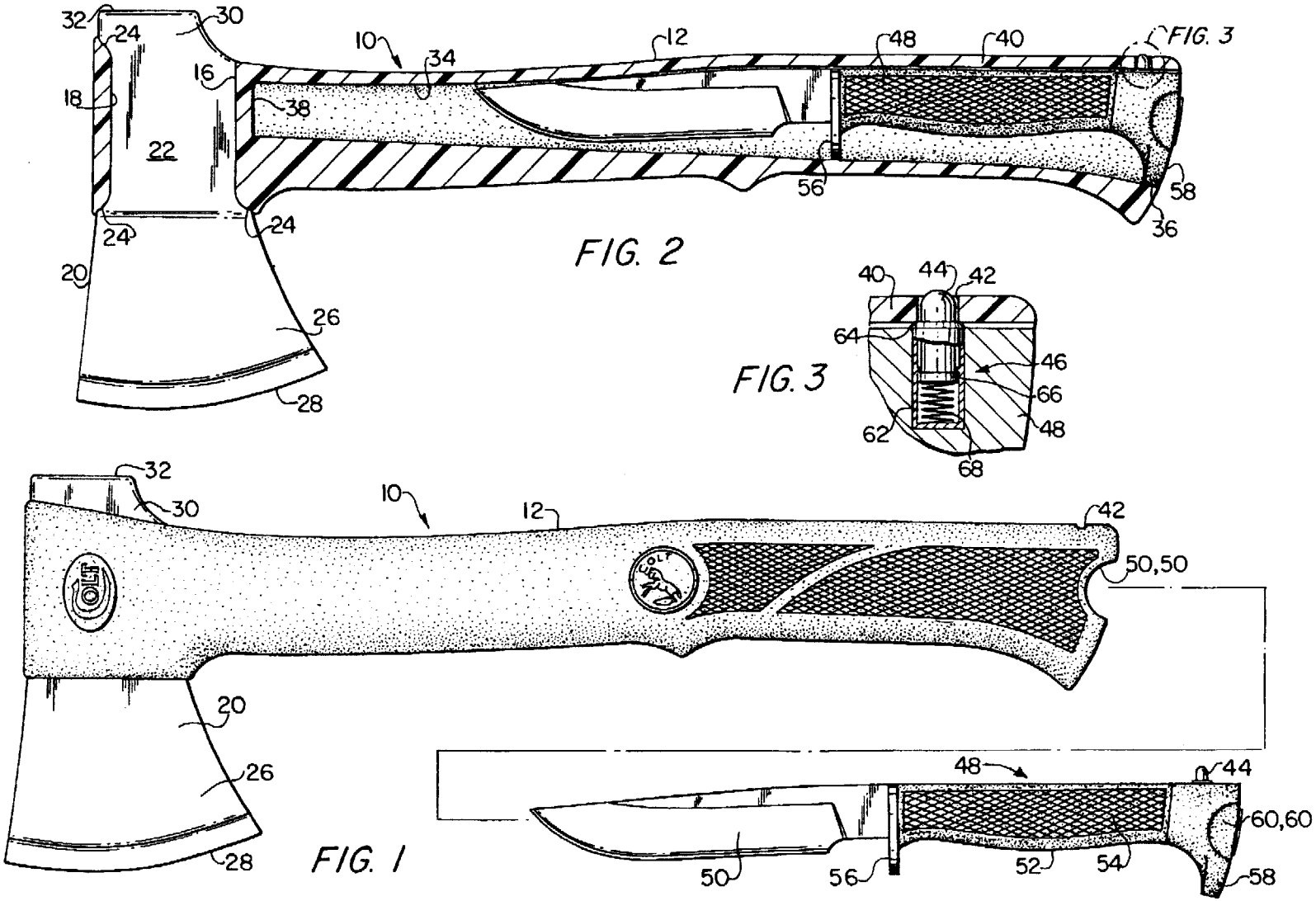
FIG. 1 is a frontal perspective view of the combination tool of the present invention with the knife removed from the axe handle.
FIG. 2 is a cross-sectional view showing the axe handle with knife contained therein.
FIG. 3 is a detailed view of the assembly for releasably securing the knife in the axe handle.

As best shown in FIGS. 1 and 2, the axe 10 of the present invention includes an elongated handle 12, which may be formed of any suitable material but is preferably formed of nylon that is molded with fiberglass filaments to enhance tensile strength and rigidity. Handle 12 includes an opening 16 that is transverse to the longitudinal axis of the handle. Opening 16 includes a restricted passageway 18 through which a narrowed section 22 of head 20 is received. Stepped or flared sections 24 of head 20 prevent it from being forced out of opening 16 while in normal use. Handle 12 may be molded with head 20 in situ, or head 20 may be pressed-fit into opening 16 after molding and secured in place with an appropriate bonding material.

Head 20 may be formed of any strong material but is preferably formed of high carbon steel. Head 20 has a longitudinal axis that is substantially perpendicular to the longitudinal axis of the handle and includes a first end 26 that is displaced from the handle along the head longitudinal axis. First end 26 includes a sharpened edge 28 for chopping and cutting and which is substantially parallel to handle 12. Head 20 includes a second end 30 that is remote from the first end 26 along the longitudinal axis of the head. Second end 30 includes a blunt edge 32 for hammering and the like and which is also substantially parallel to the handle 12.

As best seen in FIG. 2, handle 12 includes a longitudinal cavity 34 that gradually tapers from a larger open end 36 to a smaller closed end 38. Cavity 34 may be formed in any suitable manner but is preferably formed during molding of the handle. The wall 40 surrounding the cavity 34 includes a small transverse hole 42 (FIGS. 1 and 3) that passes completely through wall 40 and is sized to receive a projecting member 44 of a securing device 46 of a secondary tool 48. The outer surface of handle 12 at its lower half remote from head 20 is formed with a checkered pattern to enhance gripping. Handle 12 also includes a set of cutouts 50,50 (FIG. 1) located on opposite sides on the end of the handle remote from head 20 to allow secondary tool 48 to be gripped at one end and withdrawn from cavity 34.

Secondary tool 48 may be any full-sized implement that is useful in camping, hunting, fishing, etc., and may be for example a file, screwdriver or scissors, but will preferably be a knife. Secondary tool or knife 48 includes a blade member 50 and an integral, longitudinally aligned grasping member 52. Blade 50 and grasping member 52 may be made of any suitable hard material but are preferably stainless steel. Grasping member 52 includes a covering 54 which may be formed with a checkered gripping surface and may be made of rubber, for example.

A flange or hand-guard 56 separates blade member 50 from grasping member 52. As best seen in FIG. 2, flange 56 has an outer circumference that substantially equals the circumference of cavity 34 at a point along the length of handle 12 that is removed from the open end 36. This relationship helps to prevent knife 48 from moving from side-to-side or transverse to the longitudinal axis of axe 10 while received in handle 12. In addition, the butt end 58 of knife 48 is flared and has an increased outside diameter that substantially equals the circumference of cavity 34 at its open end 36. This relationship further prevents transverse movement of the knife 48 within cavity 34. Butt end 58 includes a set of depressions 60,60 located on opposite sides of the knife and formed substantially equal to cutouts 50,50 such that when knife 48 is fully received within cavity 34, depressions 60,60 will be aligned and coextensive with cutouts 50,50. This relationship permits knife 48 to be easily gripped on its end and withdrawn from cavity 34.

Secondary tool or knife 48 includes a securing assembly 46 (FIG. 3) that is located near its butt end. Assembly 46 includes a chamber 62 with a narrowed diameter opening 64. Located within chamber 62 is a projecting member 44 that has a first end that passes through the reduced diameter opening 64 and a flange 66 on an opposite second end, the flange having a diameter greater than opening 64 to prevent passage of member 44 completely out of chamber 62. Also included in chamber 62 is a spring 68 that biases the member 44 so that its first end projects up through opening 64. Projecting member 44 cooperates with and is received within hole 42 of handle 12 when the knife 48 is completely received within the handle to prevent longitudinal movement of the knife so that it cannot be withdrawn from the handle.

In operation, knife 48 is inserted into cavity 34 until projecting member 44 comes into contact with the wall 40 whereby axial force on the knife causes the projecting member to withdraw into chamber 62 against the force of spring 68. As the knife passes further into cavity 34, projecting member 44 comes into alignment with opening 42 and is forced therein by spring 68. Knife 48 is thereby secured within cavity 34 of axe handle 12. To remove the knife 48, the user depresses projecting member 44 while grasping the butt end 58 of knife 48 at depressions 60,60, which are accessible through cutouts 50,50 and simultaneously withdrawing the knife.

From the foregoing, it will be appreciated that any full-sized tool can be securely housed in the handle of the axe of the present invention, thereby providing carrying convenience and easy access. It will be evident that there are a number of changes, adaptations and modifications of the present invention that will occur to those having ordinary skill in the art to which the invention pertains. However, it is intended that all such variations not departing from the spirit of the invention be considered within the scope thereof as limited solely by the appended claims.

We claim:

1. An axe comprising:

a handle;

a head attached to said handle;

said handle including an open cavity for receiving a removable secondary tool, wherein said secondary tool includes a grasping member and a blade member attached to said grasping member, and wherein said handle includes a cutout open along the end rim of the handle for accessing said secondary tool when said secondary tool is received within said cavity; and means for removably securing said secondary tool within said cavity.

2. An axe comprising:

a handle;

a head attached to said handle;

said handle including an open cavity for receiving a removable secondary tool, wherein said secondary tool includes a grasping member and a blade member attached to said grasping member, and wherein said handle includes a cutout for accessing said secondary tool when said secondary tool is received within said cavity and wherein said grasping member includes a depression for grasping said secondary tool when said secondary tool is received in said cavity, said depression and cutout being substantially aligned when said secondary tool is received in said cavity; and means for removably securing said secondary tool within said cavity.

3. An axe as in claim 2 wherein said secondary tool includes a flange positioned between said grasping member and said blade member of said secondary tool, said flange having an outer circumference substantially equal to a circumference of said cavity at a point within said cavity.

4. An axe as in claim 2 wherein said secondary tool includes a knife removable secured within said handle cavity.

5. An axe as in claim 4 wherein said knife includes a grasping member coaxial with said cavity when said knife is secured in said cavity and a blade member coaxial with said grasping member when said knife is secured in said cavity.

6. An axe as in claim 5 wherein said grasping member includes a depression for grasping said knife when said knife is received in said cavity.

7. An axe as in claim 5 wherein said knife includes a flange positioned between said grasping member and said blade member, said flange having an outer circumference substantially equal to a circumference of said cavity at a point within said cavity.

8. An axe as in claim 1 wherein, said secondary tool includes a flange with a fixed circumference for travel within said cavity, said cavity having a circumference substantially equal to said fixed circumference substantially throughout said travel of said flange in said cavity.

* * * * *